US006813871B2

(12) United States Patent
Kurth et al.

(10) Patent No.: US 6,813,871 B2
(45) Date of Patent: Nov. 9, 2004

(54) FORMER FOR A PACKAGING MACHINE TO FORM PAIRS OF THREE SIDE SEALED POUCHES FROM PACKAGING FOIL MATERIAL

(75) Inventors: Gunter Kurth, Ranstadt (DE); Heinrich-Stephan Möbs, Bad Nauheim (DE); Alexander Herd, Lorsch (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 0 days.

(21) Appl. No.: 10/377,467

(22) Filed: Feb. 28, 2003

(65) Prior Publication Data

US 2003/0163979 A1 Sep. 4, 2003

(30) Foreign Application Priority Data

Mar. 2, 2002 (DE) ..... 102 09 356
Apr. 22, 2002 (DE) ..... 102 17 949

(51) Int. Cl.[7] ..... B65B 9/08
(52) U.S. Cl. ..... 53/551
(58) Field of Search ..... 53/551, 550, 450, 53/451, 530; 493/175, 163, 250; 193/32; 232/43; 422/99; 222/460

(56) References Cited

U.S. PATENT DOCUMENTS 3,837,138 A * 9/1974 Terry ..... 53/439
4,706,440 A * 11/1987 Bittner ..... 53/438
6,006,501 A 12/1999 Davis et al.
2002/0184851 A1 * 12/2002 Nakagawa et al. ..... 53/65

* cited by examiner

*Primary Examiner*—Eugene Kim
*Assistant Examiner*—John Paradiso
(74) *Attorney, Agent, or Firm*—Collard & Roe, P.C.

(57) ABSTRACT

The present invention relates generally to pouches, and more particularly to a former to form pairs of dispenser pouches of the flexible three-sided sealed type. The former has a continuous foil channel and outer guide surfaces for a foil strip to be reshaped into a double tube, which enters the channel through a foil supply edge. A pair of form- and filling pipes are arranged in the channel, which has a back wall, two front walls having two form edges, and sidewalls that are adapted to the cross-section form of the filling pipes. The wedge-shaped form edges of the front walls delimit a slit in the lower part of the former. The back wall and the form edges of the front walls, proceeding from the foil supply edge and a section that converges in continuous direction between the front walls, are developed relative to one another and continually approaching until the end of the downwardly open slit.

8 Claims, 6 Drawing Sheets

FORMER FOR A PACKAGING MACHINE TO FORM PAIRS OF THREE SIDE SEALED POUCHES FROM PACKAGING FOIL MATERIAL

BACKGROUND OF THE INVENTION

1. Field of the Invention

The invention relates generally to pouches, and more particularly to a former to form pairs of dispenser pouches of the flexible three-sided sealed type.

2. Description of Prior Art

With formers of this type, which are important elements of packaging machines for forming, filling and sealing three-sided, flexible pouches, the border areas of a foil strip approaching the former are bent over the non-folded wide center part of the strip and sealed lengthwise with said strip. This creates two connected tubes, which are first cross-sealed and filled, and then, using a suitable tool, separated in longitudinal direction for longitudinal cutting, or perforated in longitudinal direction. Generally a multiple of formers is arranged directly side-by-side, and the strips of a packaging material web, which were first appropriately cut lengthwise multiple times and are of the appropriate width, enter through said formers. Appropriately dimensioned filling pipes and forming pipes project into the former and the double tubes generated therewith.

A former of this type and/or a forming tool of this type is known from U.S. Pat. No. 6,006,501. A relatively short, specific fitting is attached directly to the lower end of said forming tool, and said fitting has a channel with a diameter that remains constant over the relatively short length of said fitting, with the channel corresponding approximately to that of a FIG. 8. The channel in the former itself has, when viewed in top view or in cross-section, the form of a slotted hole. With formers of this type, it was found that they only work somewhat acceptably with extremely thin and very flexible packaging material foil, which is also the case with the forming tool with the downstream fitting according to the aforementioned U.S. Pat. No. 6,006,501, because the foil material, which enters the downstream fitting from the direction of the former in slotted-hole shape, has to practically instantly adapt to the 8-shaped cross-section of the continuous channel in the fitting arranged below the former. In that way, the continuous channel in said downstream special fitting already corresponds to the desired final cross-section or the dispensing cross-section on the supply side of the packaging material web.

SUMMARY OF THE INVENTION

Accordingly, it is a general object of the present invention to provide an improved former, which already ensures when the foil material is wound onto the former, at the exclusion of an immediately downstream fitting, that the web already adapts successively to the typical 8-shaped final cross-section of the foil material double tube dispensed for lengthwise sealing.

It is a more particular object of the present invention to ensure an increasing approach of the two web edges to be bent to the foil material surface by the former already in the continuous channel by appropriately forming of the back wall of the continuous channel.

It is further a particular object of the present invention to arrange the back wall that delimits the continuous channel and two front walls arranged opposite said back wall such that the back wall and the front walls approach a middle plane that divides the continuous channel. It is a further and important object of the present invention that the dispensing area of the former is already designed such for the foil material that there is already a forming influence on the foil material in that area.

It is yet another particular object of the present invention to provide an improved former to allow the production of tube parts of various widths.

In accordance with the present invention, a former for a packaging machine is provided, to form pairs of three side sealed pouches from packaging foil material comprising a fitting with a channel that is open on the top and bottom and partially open toward the front; arranged in the channel are two facing, parallel running form- and filling pipes; the channel has an upper supply edge for the web; the back wall of the channel runs from the supply edge to the dispensing opening of the former; the form of the bent side walls of the channel is adapted to the round form of the form- and filling pipes and together with said pipes and the front walls of the channel forms a gap for receiving, bending and folding one strip of the foil material passing the channel; the front walls of the channel have form edges, which form edges, when bent, continually attach to the foil supply edge and delimit behind the bent connection a section converging in the continuous foil direction; at the end of said section, the front walls delimit a slit and the front walls of the channel are developed on the outside in the form of shawl-collar-like foil tail surface running out at the slit, whereby the improvement is that the back wall and the form edges of the front walls, proceeding from the foil supply edge and the converging section to the end of the downwardly open slit, are developed relative to one another with steady approximation.

Because of this development of the former in accordance with the present invention and in connection with the two filling pipes that punch through the continuous channel, the packing strip approaching said former is already formed into the final form of the double tube from the supply edge of the foil material continuously and without deformation. After leaving the fitting, the foil strip edges placed on the back wall of the foil strip are sealed lengthwise in the known manner. A fitting arranged at the lower end of the former according to U.S. Pat. No. 6,006,501 is thereby advantageously avoided.

With respect to the feature that the back wall and the front walls approach one another relatively up to the end of the former, relative should be understood such that the back wall can approach the front walls, or also that the back wall and the front walls can jointly approach an imaginary, vertical middle longitudinal plane of the continuous channel.

BRIEF DESCRIPTION OF THE DRAWINGS

The above and other features of the invention will be better understood from the following detailed description of the preferred embodiments illustrated in the accompanying drawing, where.

DESCRIPTION OF THE PREFERRED EMBODIMENTS

Figure 1:
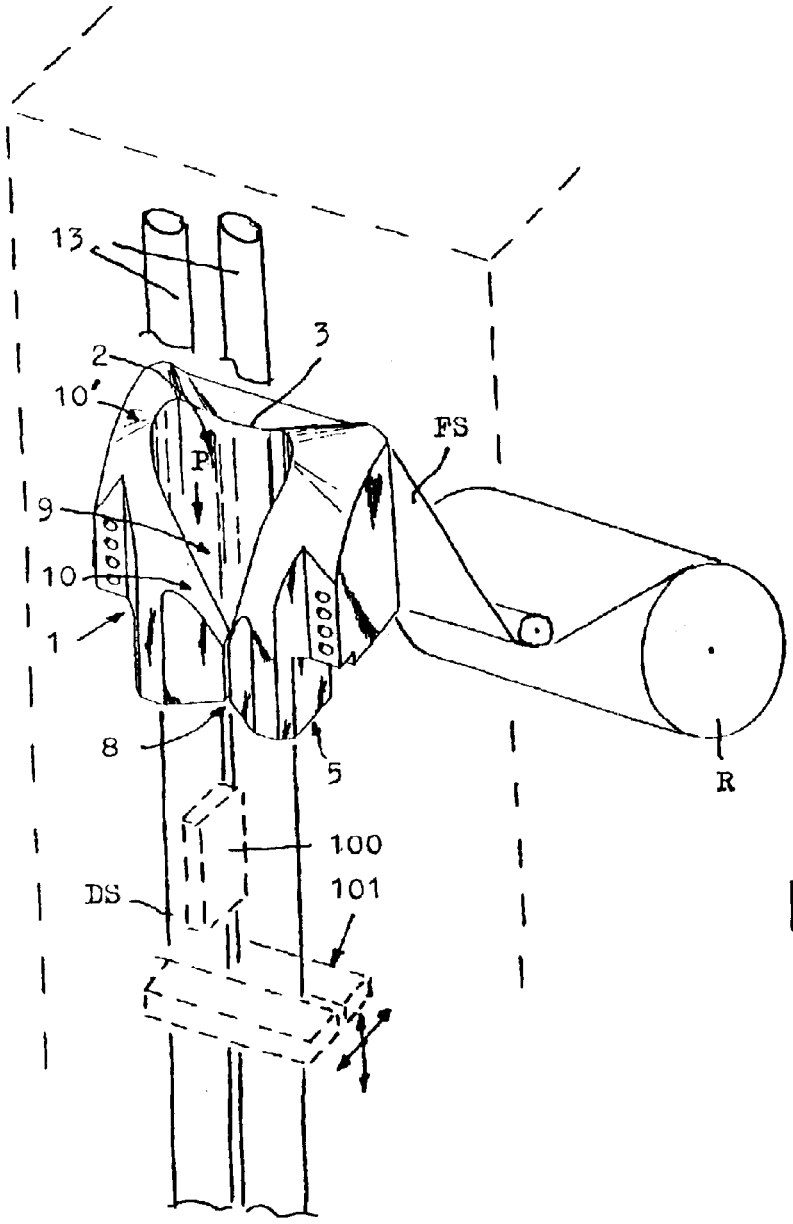
FIG. 1 shows schematically the arrangement of the former at a tube pouch packaging machine, indicated only in dashes.
Figure 10:
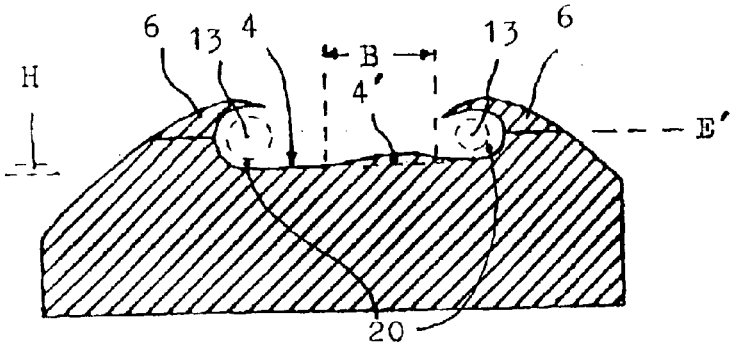
Figure 11:
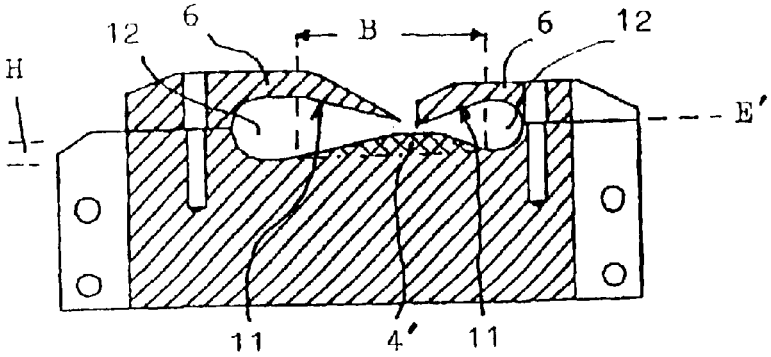

FIG. 1 shows schematically the arrangement of the former 1 in a packaging machine (indicated in dashed lines), where the foil strip FS pulled off a roll R is converted into a double tube DS by means of the former 1. 100 references a lengthwise sealing tool and 101 references a crosswise sealing tool. Form- and filling pipes 13, which are also indicated in FIG. 10, penetrate the channel 2 in the former 1. The clocked removal of the foil strip FS from the roll R is effected by the cross-sealing tools 101, which can move up and down. The form tubes 13 and the bent sidewalls 12 form a continuous gap 20 for the foil material.

Figure 1A:
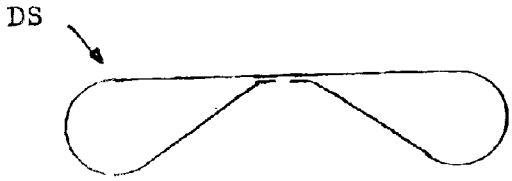
FIG. 1A shows in section a double tube produced with a former according to FIG. 2.
Figure 1B:
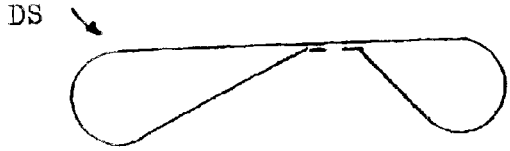
FIG. 1B shows in section a double tube produced with a former according to FIG. 3.
Figure 2:
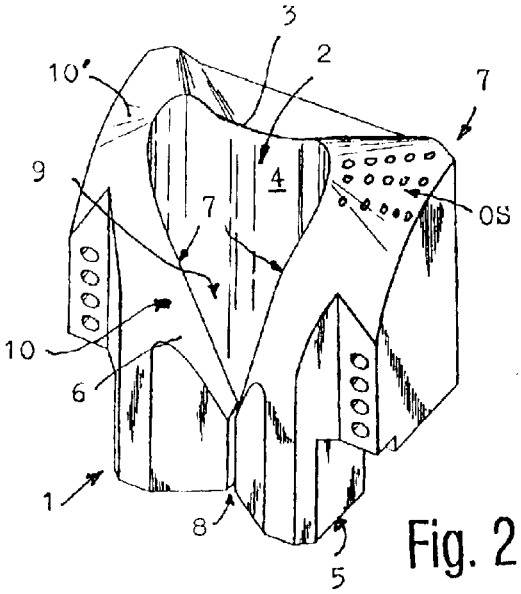
FIG. 2 shows in perspective view a symmetrical embodiment of the former.
Figure 3:
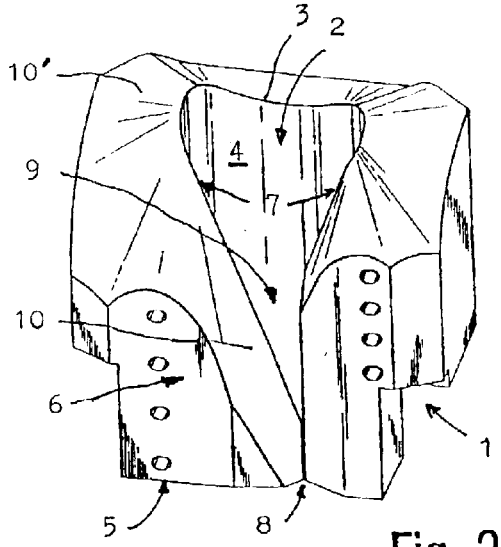
FIG. 3 shows in perspective view an asymmetrical embodiment of the former.

With reference to FIG. 2 and FIG. 3, the former consists of a block-type fitting 1 inside which runs a continuous foil channel 2, which is open on the top and the bottom. The formers according to FIG. 2 and FIG. 3 are different only in that the former according to FIG. 2 generates a symmetrical double tube (see FIG. 1A) and the former according to FIG. 3 generates an asymmetrical double tube (FIG. 1B).

Figure 7:
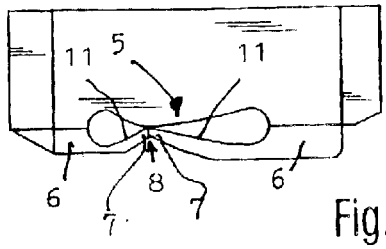
FIG. 7 shows the former according to FIG. 4 in bottom view.
Figure 8:
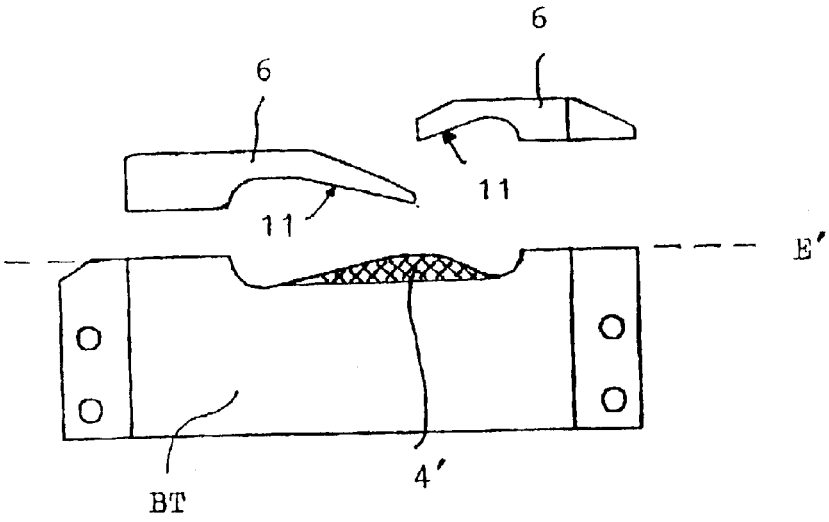
FIG. 8 shows the former according to FIG. 4 in bottom view and in a special embodiment.
Figure 9:
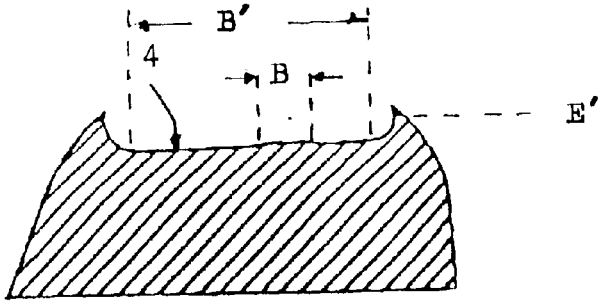
FIGS. 9–11 show sections through the former along the lines IX—IX, X—X, XI—XI in FIG. 4.

The back wall 4 of the channel 2 runs from the upper foil supply edge 3 to the lead opening 5 (see FIG. 7) of the channel 2. Said channel 2 is delimited forwardly by two channel front walls 6. The form edges 7 of the front walls 6, which connect continuously to the foil supply edge 3, define a wedge-shaped section 9 oriented in the direction of the continuous foil direction P (see FIG. 1), which coasts into a slit 8. The channel front walls 6 are developed on the outside in the form of shawl-collar-like foil guide surfaces 10 that lead at the slit 8 and connect continuously to appropriate foil guide surfaces 10' at the main body of the former 1.

In accordance with the present invention, it is provided for a former of this type that the back wall 4 from the direction of the foil supply edge 3 and/or the interior surfaces 11 of the channel front walls 6 in the direction of the continuous foil P and from the direction of the channel side areas 12 (see FIGS. 6, 7) are formed approximately asymptotic toward the lower end of the slit 8.

Figure 17:
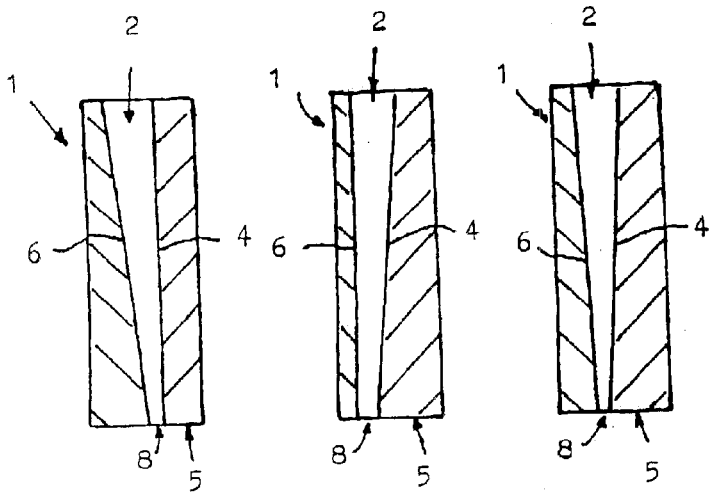
FIG. 17 shows three sections through the channel of the former perpendicular to the back wall, in schematic view, to illustrate the principle of various approaches of the back wall and the front walls of the former.

As already mentioned earlier, there are three possibilities for an approaching of this type, which is emphasized in strong schematization in FIG. 17. In the left embodiment, the front walls 6 approach the vertical back wall 4. In the middle example, the back wall 4 approaches the vertical front walls 6 and in the example on the right, which is the preferred one, the back wall 4 and the front walls 6 jointly approach one another.

Figure 6:
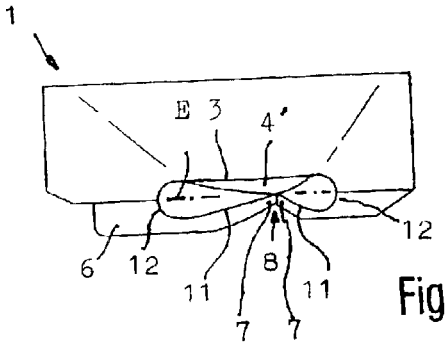
FIG. 6 shows the former according to FIG. 4 in top view.

The asymmetric embodiment shown in FIGS. 4 to 11 is an embodiment where the back wall 4 and the interior surfaces 11 of the channel front walls 6 approach one another and/or an imaginary dash dotted vertical middle plane E in FIG. 6 asymptotically. This approach is achieved in that a small ramp 4' that is trapezoid-shaped in cross section is formed into the back wall 4 (see especially FIGS. 9 to 11). The cross-sections of said ramp 4' become larger increasingly proceeding from foil supply edge 3. The ramp 4' has a fraction of the width B' (see FIG. 4) of the foil supply edge 3 at said foil supply edge and continually gains in height H and width B until it ends at the slid 8. With respect to the growing cross-section of ramp 4', reference is made to FIG. 8 to FIG. 11, which also show the height and widths H, B, and B'.

The former 1 and its continuous foil channel 2 and the channel front walls 6, as shown in FIGS. 1, 2, are formed from a block that can be appropriately program-controlled by means of CNC-milling or by means of erosion processes and thus can be produced with identical reproduction. To simplify this, the block 7 is advantageously developed divided by a vertical plane E' that runs parallel in the continuous direction P and to the foil supply edge 3 (see FIGS. 8 to 11) forming separate channel front walls 6. With respect to a division of this type, reference is made in particular to FIG. 8.

The aforementioned production methods, of which CNC-milling is the preferred one, furthermore make it possible in an easy and advantageous manner to provide the surfaces touched by the continuous web (foil material guide surfaces 10, 10') of the former at least in the leading area 13 of the block 7 with a nappy and waffle iron-type surface structure OS, which is indicated in only one partial area in FIG. 2. For this structuring, depths in a range of tenths of millimeters are sufficient for a sufficient quantity of sterilizing agent to reach between the foil material guide surfaces 10, 10' and the foil material strips FS if the tube pouches are produced under sterile conditions, which is generally the case.

Figure 12:
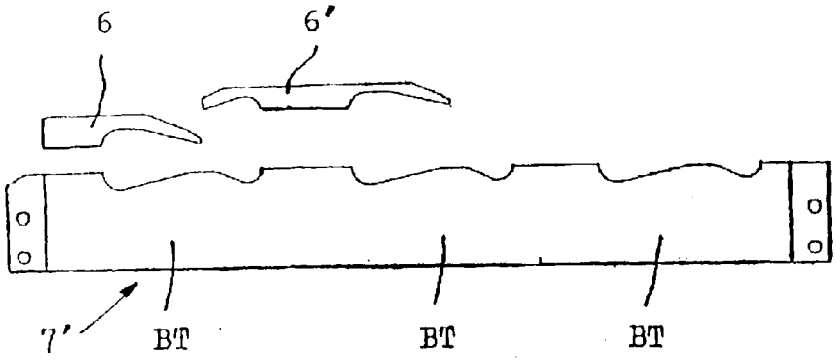
FIG. 12 shows a special embodiment of the former.
Figure 12A:
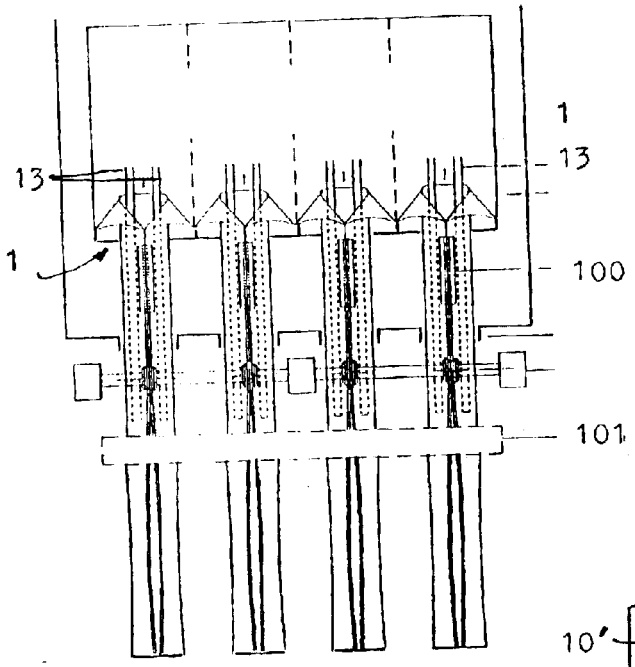
FIG. 12A shows a schematic frontal view of a tube pouch machine with four formers arranged in series.
Figure 13:
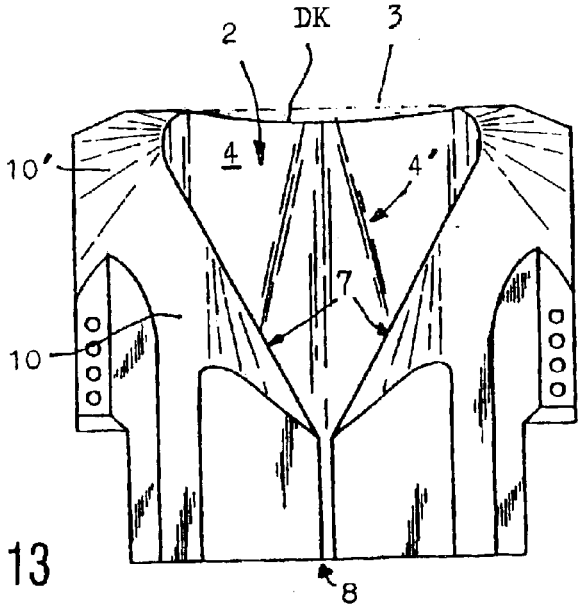
FIG. 13 shows another and preferred embodiment of the former.

Because the arrangement of several formers at tube pouch machines of this type is generally the rule (see FIG. 12A), a block development of this type offers the advantageous option to combine the back block parts BT of such formers into one large block 7', onto which the channel front walls 6 are screwed, and with the exception of the ones arranged at the two edges, two each front walls 6 can again be combined into one cover 6' according to FIG. 12.

Figure 14:
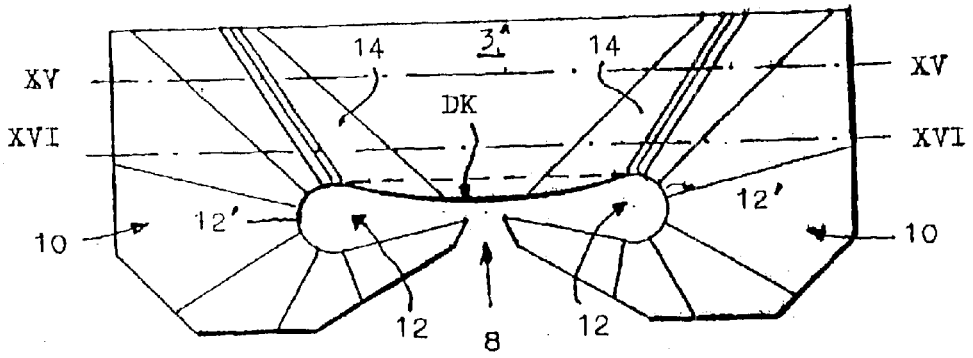
FIG. 14 shows a top view of the former according to FIG. 13.
Figure 15:
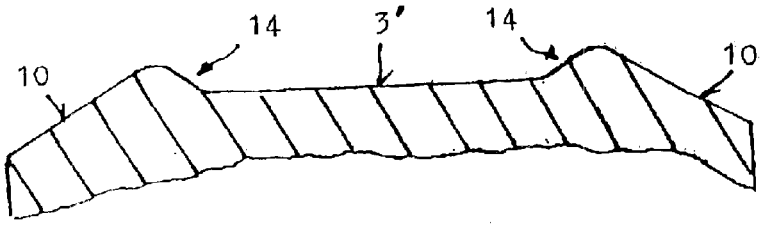
FIG. 15 shows a significantly enlarged section through the former along the line XV—XV in FIG. 14.
Figure 16:
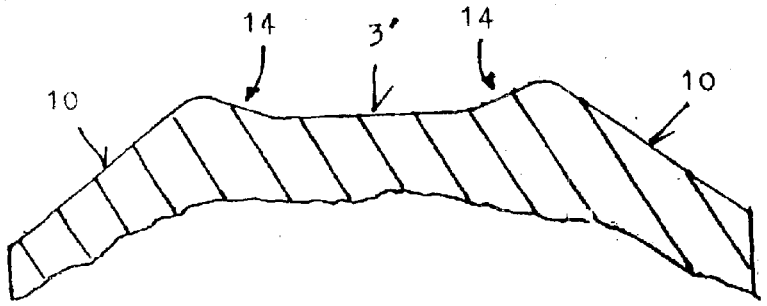
FIG. 16 shows a greatly enlarged section through the former along the line XVI—XVI in FIG. 14.

With respect to FIGS. 13 to 16, an advantageous and preferred embodiment of the former according to the present invention is that the foil supply edge 3 in top view is a slightly convex bulging intersection curve DK in the direction of the continuous foil channel 2, which is formed by the penetrations of the surface of the back wall 4 and the foil supply surface 3'. The foil supply surface 3' has side wall areas 14 that converge and get wider towards the penetration curve DK, as is shown in FIG. 14, and said side wall areas increase continually from the surface 3' and run into the foil guide surfaces 10', as is shown in the sections XV—XV and XVI—XVI of FIGS. 15, 16. It goes without saying that the aforementioned ramp 4' is also found with this embodiment.

With this development of the foil supply edge 3 in form of a convex bulging penetration curve DK according to the present invention, a better adaptation of the supplied foil strip FS to the cross-section form of the continuous foil channel 4 is already achieved in said area of the former 1. The border areas of the supplied foil are pulled in somewhat stronger, causing the foil to adapt better to the strongly concave side edge bulges of the continuous channel 2. Specific pleating occurring at other times with a straight foil supply edge 3 is thereby avoided or greatly reduced.

Figure 4:
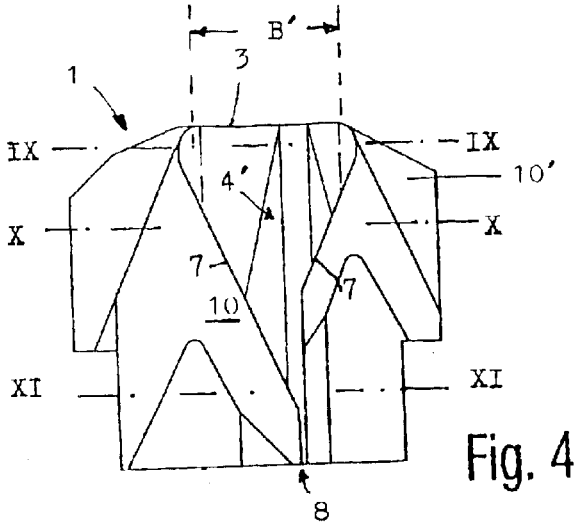
FIG. 4 shows the former according to FIG. 3, in frontal view.
Figure 5:
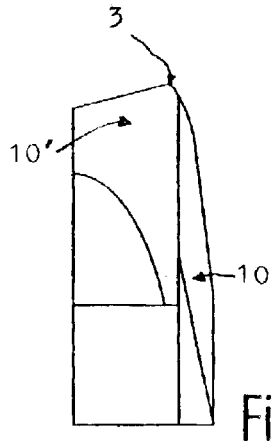
FIG. 5 shows the former according to FIG. 4, in side view.
Figure 18:
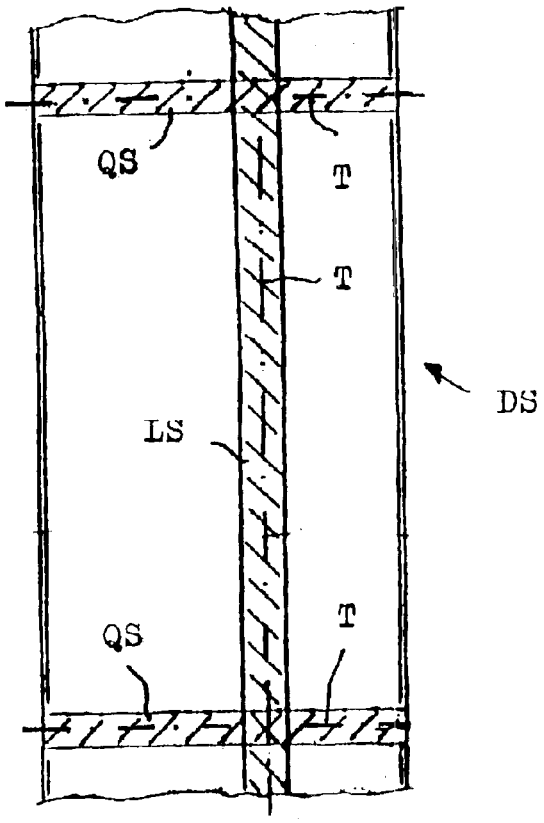
FIG. 18 shows the double tube formed with the former according to FIG. 3 or FIG. 13.
Figure 19:
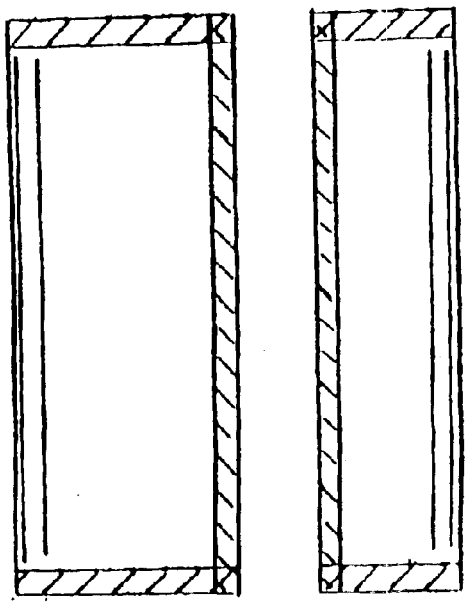
FIG. 19 shows a section through the double tube according to FIG. 18 along the line XVIII—XVIII in FIG. 17.

For the sake of completeness, FIG. 18 shows a double pouch strand DS with its longitudinal seal seam LS and its cross-seal seams QS, as it results with a former according to FIGS. 3, 4. Finally, FIG. 19 shows two pouches with different widths, which are obtained after the separation along the dashed lines T from the strand according to FIG. 18.

What is claimed is:

1. A former for a packaging machine for manufacturing three-sided sealed pouches from packaging foil material, which comprises a back wall extending from an upper foil material supply edge to a dispensing opening; a pair of shawl-like front walls having interior surfaces and outer guide surfaces for the foil material, the front walls having form edges extending from the upper foil material supply edge in a direction of foil material supply from the upper foil material supply edge to a slit extending in said direction to the dispensing opening, the form edges converging in said direction toward the slit to form a wedge-shaped section; curved side walls connecting the back wall and the front walls; a channel open on top and bottom, the channel extending between the back wall, the side walls and the front walls from the upper foil material supply edge to the dispensing opening; and form- and filling pipes arranged in the channel; wherein the improvement comprises that the back wall and the interior surfaces of the front walls are formed asymptotically steadily closer in said direction from the foil material supply edge to a lower end of the slit.

2. The former of claim 1, comprising a ramp that is approximately trapezoid-shaped in cross-section, the ramp extending from the foil material supply edge to the lower end of the slit, having a fraction of the width of the foil material supply edge at said supply edge and continually increasing in width and height towards the end of the slit.

3. The former of claim 1, comprising a foil material supply surface leading to the foil material supply edge, two side walls adjacent said supply surface, said side walls widening and converging towards said supply edge and rising from said supply surface towards the outer guide surface for the foil material which are connected thereto and descend therefrom.

4. The former of claim 1, wherein the wedge-shaped section and the slit are asymmetrically arranged relative to the middle of the foil material supply edge.

5. The former of claim 1, wherein the back wall, the front walls and the connecting side walls form a block.

6. The former of claim 5, wherein the block is divided by a plane extending parallel to the foil material supply direction to form the two front walls.

7. The former of claim 1, wherein several back walls are combined into a block and separate pairs of front walls are arranged on the block of back walls.

8. The former of claim 7, wherein surfaces of the former contacted by the foil material supplied to the former are nubby at least in a supply region of said foil material to the former.

* * * * *